US010221625B1

(12) United States Patent
Bernhard, Jr. et al.

(10) Patent No.: US 10,221,625 B1
(45) Date of Patent: Mar. 5, 2019

(54) ATTACHMENT FOR A LADDER

(71) Applicants: Wilhelm K. Bernhard, Jr., Louisville, KY (US); Wilhelm K. Bernhard, III, Louisville, KY (US); David F. Bremner, Prospect, KY (US); Stephen Warden, Louisville, KY (US)

(72) Inventors: Wilhelm K. Bernhard, Jr., Louisville, KY (US); Wilhelm K. Bernhard, III, Louisville, KY (US); David F. Bremner, Prospect, KY (US); Stephen Warden, Louisville, KY (US)

( * ) Notice: Subject to any disclaimer, the term of this patent is extended or adjusted under 35 U.S.C. 154(b) by 0 days.

(21) Appl. No.: 15/916,391

(22) Filed: Mar. 9, 2018

Related U.S. Application Data

(60) Provisional application No. 62/471,433, filed on Mar. 15, 2017.

(51) Int. Cl.
*E06C 7/14* (2006.01)

(52) U.S. Cl.
CPC ..... *E06C 7/14* (2013.01)

(58) Field of Classification Search
CPC ... E06C 7/14; E06C 7/16; E06C 7/165; E06C 1/39; E06C 1/393; E06C 7/00; A47B 96/02; A47B 96/16; A47B 96/025
USPC ..... 211/70.6, 86.01, 119.003, 119.006, 211/119.008, 126.1; 248/210, 211, 238, 248/221.11, 222.11, 222.13, 222.51, 248/231.21, 231.51, 231.61, 231.85; 108/42, 152; 182/129, 120, 126
See application file for complete search history.

(56) References Cited

U.S. PATENT DOCUMENTS 607,891 A * 7/1898 Smith ..... A47F 5/005 211/184
666,099 A * 1/1901 Kepler ..... E06C 7/14 248/210
1,200,936 A * 10/1916 Hall ..... E06C 7/14 248/210
1,358,277 A * 11/1920 Bochard ..... E06C 7/14 248/210
1,808,647 A * 6/1931 Fazekas ..... E06C 7/14 248/211
2,098,996 A * 11/1937 Blake ..... E04D 15/00 248/210
2,102,078 A * 12/1937 Kemp ..... E06C 7/14 105/422
2,162,022 A * 6/1939 Mansfield ..... E06C 7/14 182/116
2,174,891 A * 10/1939 Maran ..... E06C 7/16 182/121
2,541,434 A * 2/1951 Nelson ..... E06C 7/14 192/105 BB
2,550,365 A * 4/1951 McKenzie ..... E06C 7/14 24/457
2,775,489 A * 12/1956 Hagadorn ..... E04G 3/00 182/129
2,942,830 A * 6/1960 Senay ..... E06C 7/14 248/201
3,131,900 A * 5/1964 Anderson ..... E06C 7/14 248/210
3,374,980 A * 3/1968 Chovan ..... B44D 3/14 248/210

(Continued)

*Primary Examiner* — Jennifer E. Novosad
(74) *Attorney, Agent, or Firm* — Kenneth F. Pearce

(57) ABSTRACT

An attachment for a ladder where the attachment includes a superior article carrying surface.

18 Claims, 10 Drawing Sheets

(56) References Cited

U.S. PATENT DOCUMENTS 3,987,993 A * 10/1976 Hopkins ..... E06C 7/14 248/210
4,395,013 A * 7/1983 Wissinger ..... F16M 13/00 248/210
4,676,468 A * 6/1987 Preston ..... E06C 7/14 182/120
5,058,707 A 10/1991 Waid
5,191,954 A * 3/1993 Ledford ..... E06C 7/143 182/121
5,624,093 A * 4/1997 Gemmell ..... B44D 3/125 220/570
5,791,609 A * 8/1998 Hankins ..... F16M 13/02 248/124.1
5,941,399 A * 8/1999 Wang ..... F16B 12/32 211/187
6,024,192 A * 2/2000 Griffin ..... B25B 1/2484 182/129
6,341,666 B1 * 1/2002 Allen ..... E06C 7/14 182/129
6,357,706 B1 * 3/2002 Fleckenstein ..... E06C 7/14 182/129
6,370,741 B1 * 4/2002 Lu ..... A47B 21/045 24/523
6,513,626 B2 * 2/2003 MacSweeney ..... E06C 7/14 182/129
6,666,342 B1 * 12/2003 House ..... B25H 3/06 211/70.6
6,698,548 B1 * 3/2004 Verrill ..... E06C 1/39 182/129
6,729,439 B1 * 5/2004 Zlatis ..... B25H 3/04 182/129
6,910,429 B1 * 6/2005 Matay ..... B25H 3/06 108/152
7,032,711 B1 * 4/2006 Katz ..... B25H 3/06 182/129
7,374,018 B1 * 5/2008 Thrun ..... E06C 7/14 182/129
7,866,617 B2 * 1/2011 Kleitsch ..... A61M 5/1417 248/228.5
8,074,769 B2 * 12/2011 Sracic ..... E06C 7/12 182/101
9,695,977 B2 * 7/2017 Blalock ..... F16M 13/022
9,714,542 B1 7/2017 Harcz
2003/0029676 A1 * 2/2003 Gibson ..... E06C 1/393 182/161
2004/0173717 A1 * 9/2004 Wallther ..... E04G 1/15 248/211
2005/0247838 A1 * 11/2005 Zodnik ..... E06C 7/14 248/238
2005/0258002 A1 * 11/2005 Sabo ..... E06C 7/14 182/129
2006/0016953 A1 * 1/2006 Beck ..... A47B 41/06 248/460
2006/0192063 A1 * 8/2006 Angotti ..... E06C 7/14 248/210
2009/0242580 A1 * 10/2009 Conner, Sr. ..... E06C 7/14 220/751
2011/0272211 A1 * 11/2011 Beachy ..... E06C 7/14 182/129
2012/0126073 A1 * 5/2012 Singleton ..... B61K 3/00 248/201
2012/0187266 A1 * 7/2012 Schirmacher ..... E06C 7/14 248/238
2013/0220951 A1 8/2013 Dufour
2017/0130530 A1 5/2017 Lawler et al.

* cited by examiner

ATTACHMENT FOR A LADDER

This Nonprovisional Application entitled "Attachment for a Ladder" claims priority to US Provisional Application entitled "Attachment for a Ladder," Ser. No. 62/471,433; filed Mar. 15, 2017; Bernhard, et al., and pursuant to Title 35 of the United States Code, Applicants claim all rights flowing therefrom.

BACKGROUND OF THE INVENTION

1. Field of the Invention

Among other things, the current invention is an attachment for a ladder. More specifically, the attachment improves the user's workspace associated with the ladder.

2. Description of the Previous Art

Any discussion of references cited in this Description of the Previous Art merely summarizes the disclosures of the cited references and Applicants make no admission that any cited reference or portion thereof is relevant prior art. Applicants reserve the right to challenge the accuracy, relevancy and veracity of the cited references.

US Published Patent Application 20170130530—Lawler, et al. discloses an attachable platform.

US Published Patent Application 20130220951—Dufour discloses a shelf apparatus for use with a ladder and scaffold.

U.S. Pat. No. 9,714,542—Harcz discloses a ladder storage assembly.

U.S. Pat. No. 6,698,548—Verrill discloses a ladder platform.

U.S. Pat. No. 5,058,707—Waid discloses a work shelf for a folding stepladder.

Based on the current record, it does not appear that the above identified references disclose a connector combination attachable to a crosspiece of the ladder, where Applicants' nonobvious and novel combination is connected to the inferior side of the attachment and adapted to secure the attachment to the crosspiece. More specifically, the previously identified references do not disclose, teach or suggest a connector combination comprising: an adjustable grip gripping a first edge of the crosspiece; a pivoting clasp adapted to engage a second edge of the crosspiece; and a rotatable body including an asymmetrical area contacting the pivoting clasp, where a first rotation of the rotatable body forces the pivoting clasp to clamp against the second edge of the crosspiece.

SUMMARY OF THE INVENTION

The current attachment for a ladder is particularly useful for carrying hand tools, workpieces and/or other articles, An aspect of the present invention is to provide an attachment with a superior article carrying surface of sufficient surface area to allow the user to expend less time mounting and unmounting the ladder to acquire necessary tools, workpieces and/or other articles.

Another aspect of the present invention is to provide an attachment than can be securely attached to a ladder having one or more crosspieces.

Still another aspect of the present invention is to provide an attachment that can be quickly attached or unattached to the crosspiece.

Yet another aspect of the present invention is to provide a method for attaching an attachment to the crosspiece of a ladder.

A preferred embodiment of the present invention can be described as an attachment for a ladder including a top piece spanning between opposed legs of the ladder; the attachment comprising: a) a superior side for carrying articles; and b) an inferior side opposite the superior side adapted to contact at least a portion of the top piece; the inferior side comprising: i) an extension extending away from the inferior side; the extension further comprising: a slot; a slidable grip riding along the slot; and a lock adapted to lock the slidable grip against a first edge of the top piece; ii) first and second mounts opposite the extension; the mounts extending away from the inferior side; iii) a shaft extending between the second mounts; iv) an axle extending from the first mount; v) a pivoting clasp carried by the shaft; the clasp adapted to engage a second edge, opposite the first edge, of the top piece; vi) a handle extending from a rotatable body; the rotatable body carried by the axle and adapted to engage the pivoting clasp such that a first rotation of the rotatable body forces the pivoting clasp to lock against the second edge; and vii) a release adapted to allow the rotatable body to rotate in a second direction, thereby unlocking the pivoting clasp from the second edge.

Another preferred embodiment of the present invention can be described as an attachment for a ladder including a member spanning between opposed legs of the ladder; the attachment comprising: a) a superior side for carrying articles; and b) an inferior side adapted to contact at least a portion of the member; the inferior side comprising: i) an extension extending away from the inferior side; the extension further comprising: a lock adapted to lock a slidable grip against a first edge of the member; ii) first and second mounts opposite the extension; the mounts extending away from the inferior side; iii) a shaft extending between the second mounts; iv) an axle extending from the first mount; v) a pivoting clasp carried by the shaft; the clasp adapted to engage a second edge of the member; vi) a rotatable body carried by the axle; the rotatable body adapted to engage the pivoting clasp such that a first rotation of the rotatable body forces said pivoting clasp to lock against the second edge.

Still another preferred embodiment of the present invention can be described as an attachment for a ladder including a member spanning between opposed legs of the ladder; the attachment comprising: a) a superior side for carrying articles; b) an inferior side adapted to contact at least a portion of the member; and c) a connector connected to the inferior side and adapted to secure the attachment to the ladder; the connector comprising: i) a grip gripping a first edge of the member; ii) a pivoting clasp adapted to engage a second edge of the member; and iii) a rotatable body comprising an asymmetrical area contacting the pivoting clasp such that a first rotation of the rotatable body forces the pivoting clasp to clamp against the second edge.

Still another preferred embodiment of the present invention can be described as a method of connecting an attachment to ladder comprising the steps of providing an attachment for a ladder, wherein the attachment comprises a superior article carrying side and an inferior side adapted for connection to a crosspiece of the ladder; connecting a connector to the inferior side, wherein the connector comprises first and second components; the first component comprising a grip adapted to grip a first edge of the crosspiece; and the second component comprising a pivoting clasp adapted to engage a second edge of the member and a rotatable body comprising an asymmetrical area contacting the pivoting clasp; securing the grip to the crosspiece; rotating the rotatable body in a first direction to lock the pivoting clasp against the crosspiece; rotating the rotatable body in a second direction to unlock the pivoting clasp from the crosspiece.

It is the novel and unique interaction of these simple elements which creates the apparatus and methods, within the ambit of the present invention. Pursuant to Title 35 of the United States Code, descriptions of preferred embodiments follow. However, it is to be understood that the best mode descriptions do not limit the scope of the present invention.

DESCRIPTION OF THE PREFERRED EMBODIMENTS

The disclosure hereof is detailed to enable those skilled in the art to practice the invention, and the embodiments published herein merely exemplify the present device and do not limit the scope of any claims appended hereto.

Figure 1:
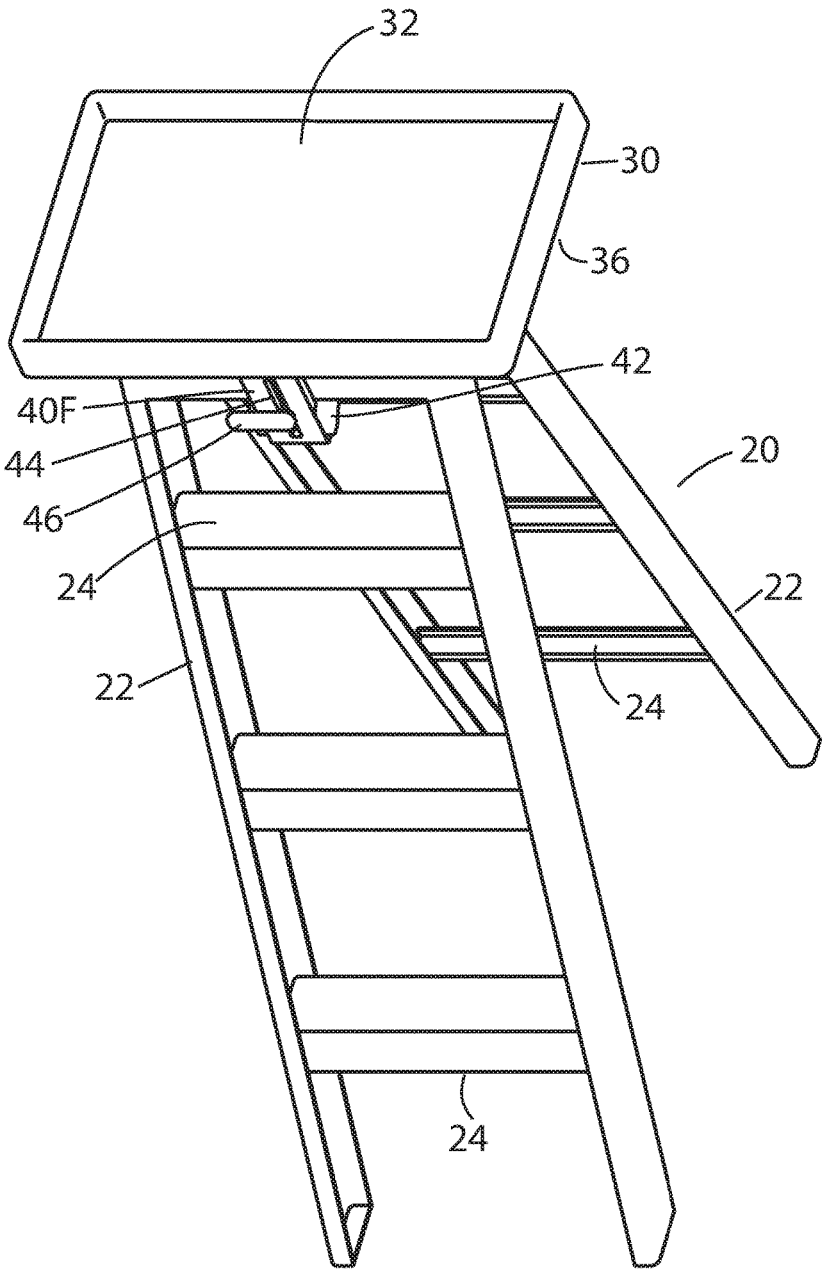
FIG. 1 is a perspective of a preferred embodiment of the current attachment attached to a crosspiece of a ladder.

FIG. 1 is a perspective of a preferred embodiment of the current attachment illustrating how attachment (30) can be attached to a top piece or member (24) connected to legs (22) of a ladder. As shown, ladder (20) includes legs (22) and a plurality of crosspieces or members (24) connected to the legs.

Attachment (30) is provided with a superior side (32) capable of carrying articles and an inferior side (36) opposite superior side (32). As shown in FIG. 1, the first component of connector (40F) is connected to inferior side (36) of attachment (30) and extends away from inferior side (36) of attachment (30). In this preferred embodiment shown, first component of connector (40F) includes grip (42), slot (44), lock (46) and extension (48) (not shown in this view). In the practice of a preferred embodiment of the current invention, the first component of connector (40F) is capable of contacting a side of one the crosspieces or members (24) and is lockable against the member (24). In select preferred embodiments, the first component of connector (40F) can be supplied with a torsion lock (46) for locking connector (40) against crosspiece (24). Within the scope of the current invention, other preferred embodiments can utilize a clamping or other mechanism for locking the first component of connector (40) against member (24).

Figure 2:
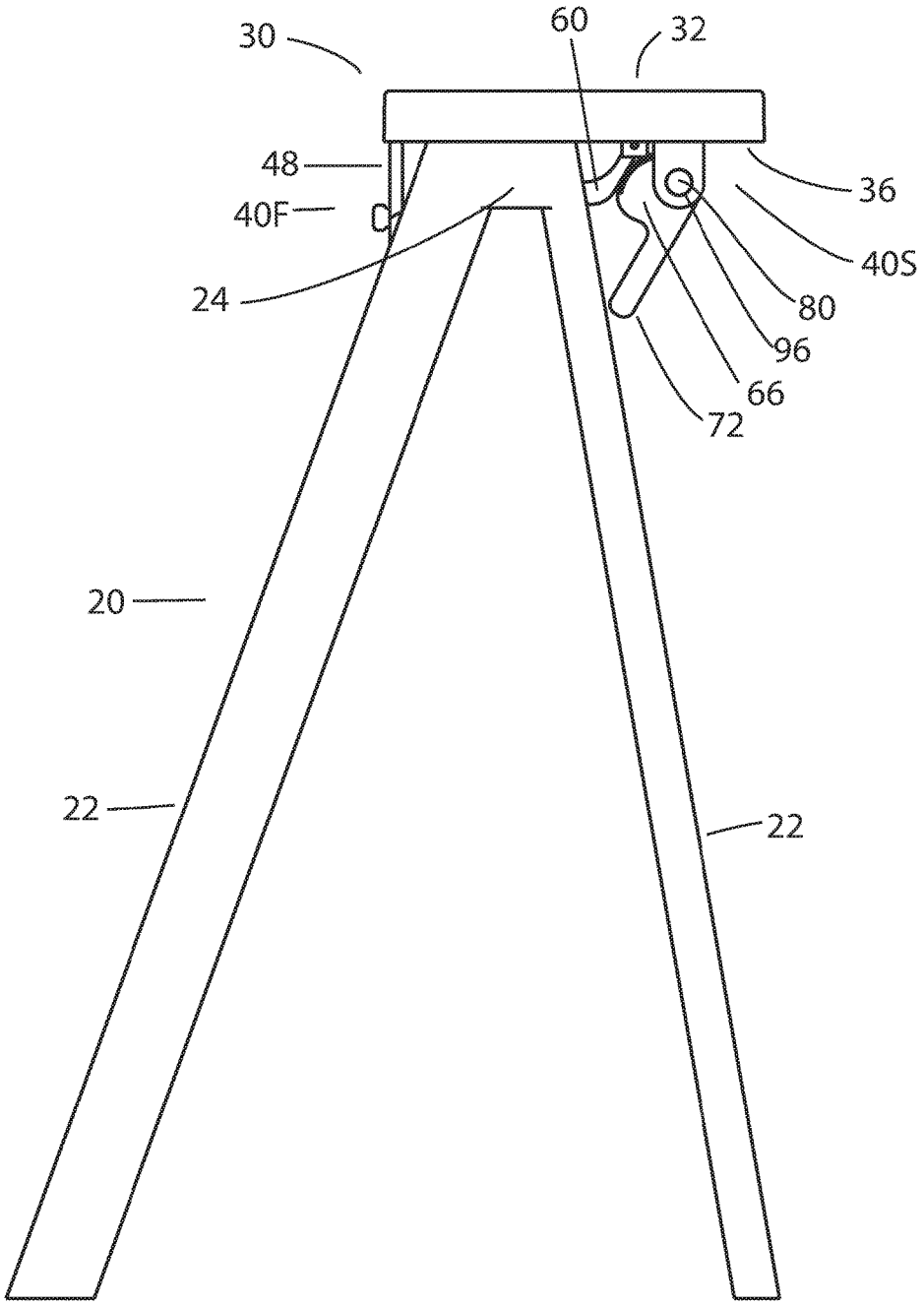
FIG. 2 is a lateral view of attachment (30) connected to ladder (20).
Figure 3:
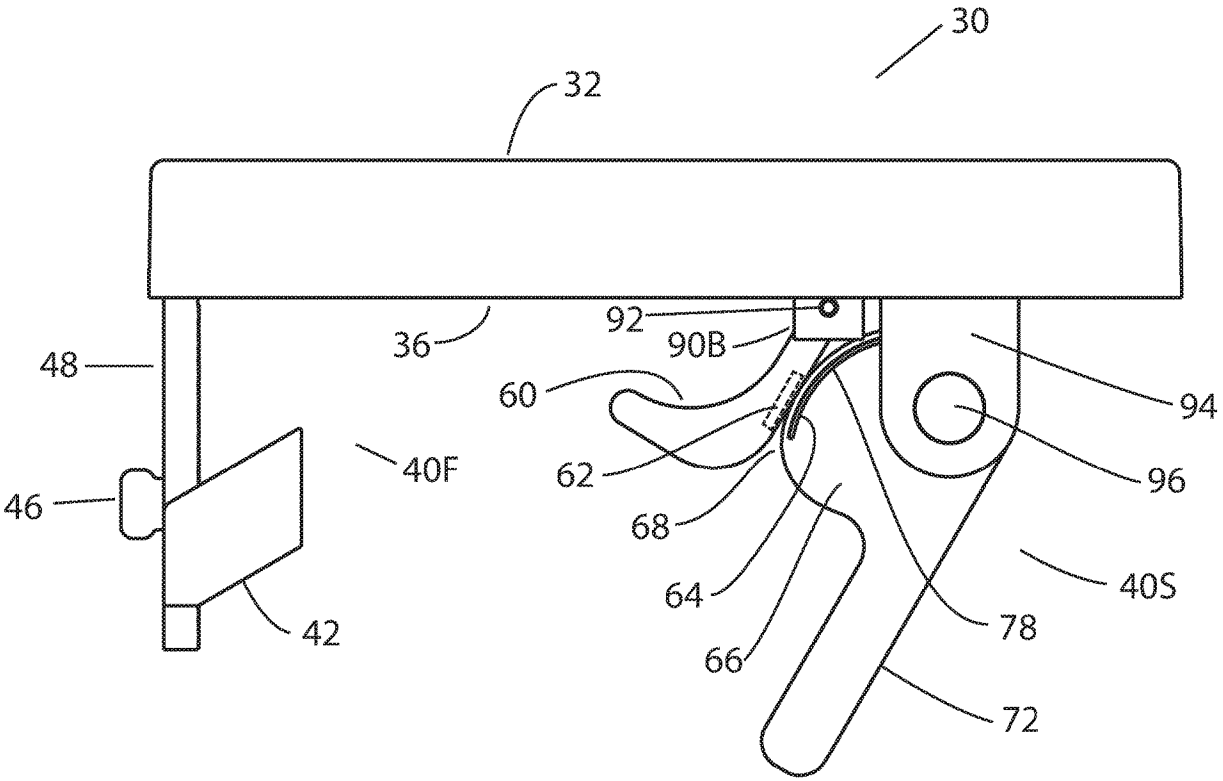
FIG. 3 is a lateral view of attachment (30) disclosing first and second components (40F, 40S) of the connector.

FIG. 2 is a lateral view of attachment (30) connected to ladder (20). First and second components of connector (40F, 40S) are shown in FIG. 2. Lock (46) is capable of locking grip (42) (not shown in this view) of extension (48) against a side of top piece (24). As shown in FIG. 2, second component (40S) is opposite first component (40F). Second component (40S) is provided with pivoting clasp (60) for clasping a side of top piece (24). Rotation of rotatable body (66) in a first direction is capable of forcing pivoting clasp (60) to securely engage top piece (24). Rotatable body (66) can be supplied with release (80) that allows rotatable body (66) to rotate in a second direction, thereby allowing pivoting clasp (60) to unclasp member (24). Select preferred embodiments of rotatable body (66) can be provided with handle (72). FIG. 3 is a lateral view of attachment (30) disclosing first and second components (40F, 40S) of connector. As previously indicated, first component (40F) includes grip (42), slot (44) (not shown in this view), lock (46) and extension (48). In the preferred embodiment disclosed in FIG. 3, second component's (40S) pivoting clasp (60) can rotate about shaft (92) extending between mounts (90A, 90B) attached to inferior side (36) of attachment (30). Select preferred embodiments of pivoting clasp (60) can include magnet (62) (shown in phantom). Rotatable body (66) can rotate about axle (96) positioned on mount (94) attached to inferior side (36) of attachment (30). As shown in FIG. 3, rotatable body (66) is provided with an asymmetrical area (68) contacting pivoting clasp (60) capable of forcing pivoting clasp (60) to engage a side of a member (24) of ladder (20). Select preferred embodiments of rotatable body (66) can be provided with conduit (64) holding a substance (78) of sufficient volume to draw magnet (62) toward substance (78). Within the scope of the current invention, substance (78) can include but is not limited to steel or an alloy thereof.

Figure 4:
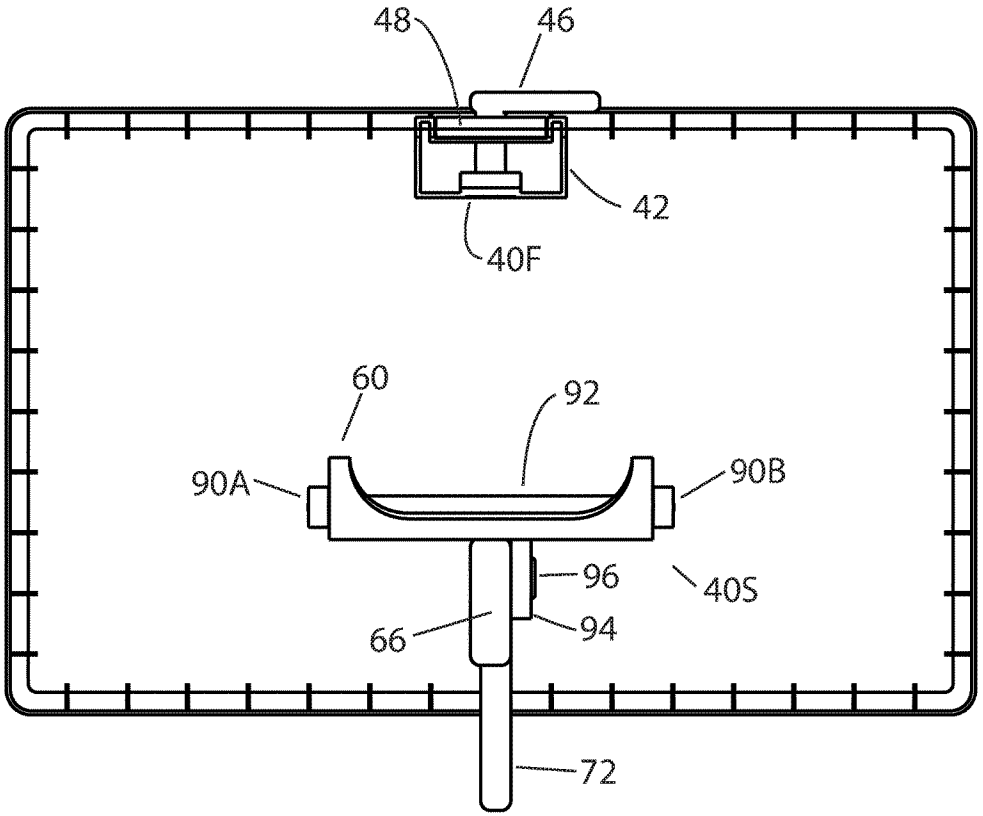
FIG. 4 is a frontal view of inferior side (36) of attachment (30).

FIG. 4 is a frontal view of inferior side (36) of attachment (30). First component (40F) includes locking grip (42), lock (46) and extension (48). As shown in this preferred embodiment of the second component, connector (40S) is provided with shaft (92) extending between mounts (90A, 90B) connected to inferior side (36). Pivoting clasp (60) can be rotated about shaft (92). Rotatable body (66) can rotate about axle (96) positioned on mount (94) attached to inferior side (36) of attachment (30). As shown, rotatable body (66) is provided with handle (72). Rotatable body (66) is capable of applying force to rotate pivoting clasp (60) in a first direction and also releasing locking force, thereby allowing pivoting clasp (60) to be rotated in a second direction.

Figure 5:
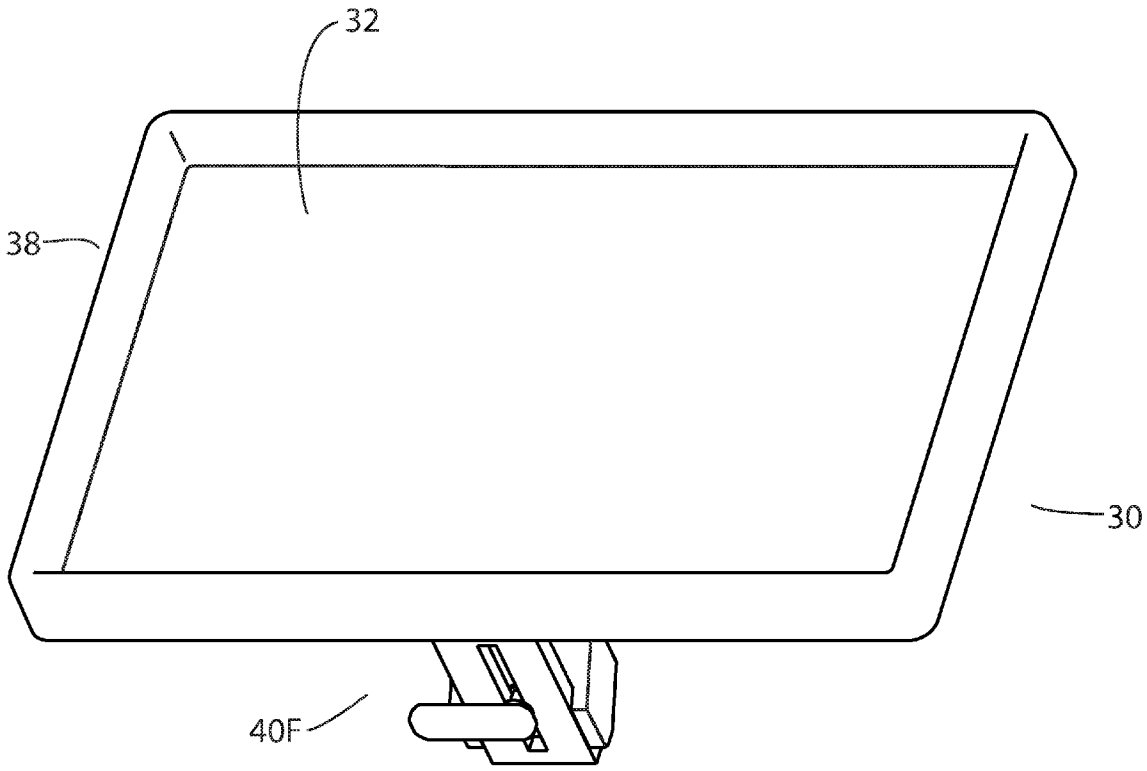
FIG. 5 is a perspective of superior side (32) of attachment (30).

FIG. 5 is a perspective of superior side (32) of attachment (30). As shown, superior side (32) can be provided with a ridge (38) extending upward from superior side (32). Although not shown in FIG. 5, select preferred embodiments of support (30) can be provided with one or more apertures for carrying tools or other workpieces.

Figure 6:
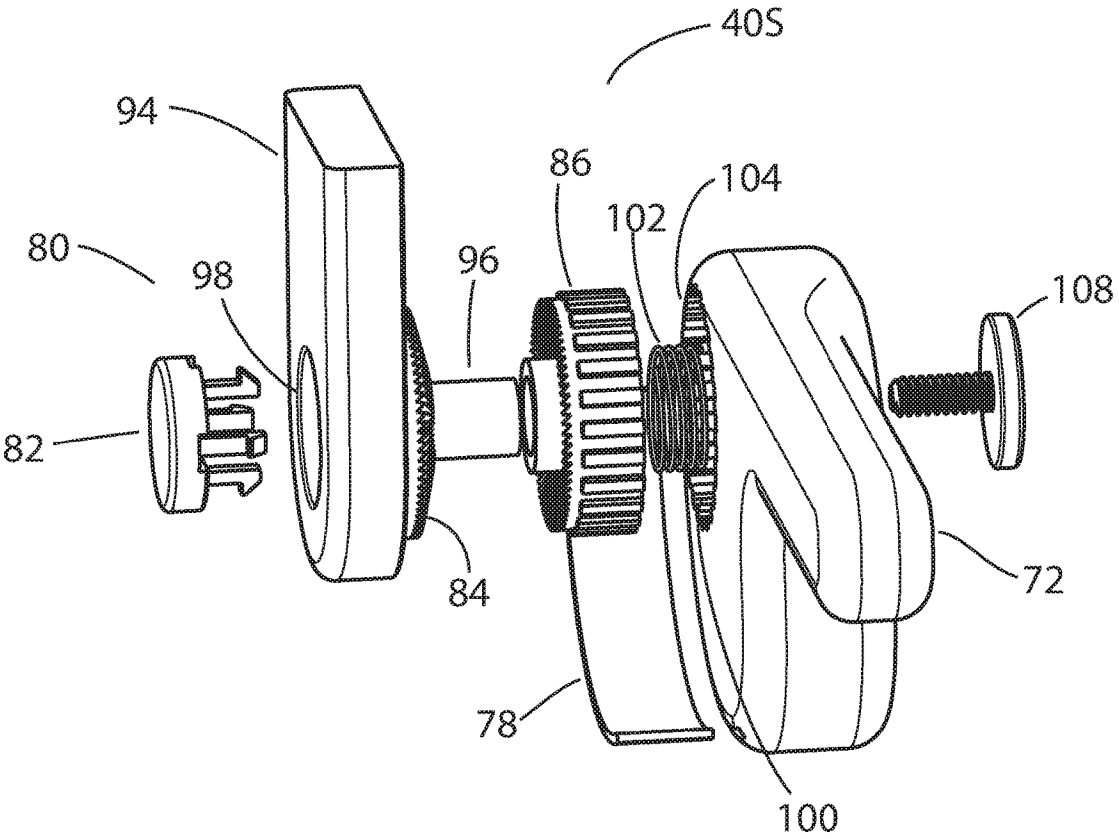
FIG. 6 is an exploded perspective of a preferred embodiment of second component (40S) of the connector.

FIG. 6 is an exploded perspective of a preferred embodiment of second component (40S) of connector. Mount (94) is provided with opening (98). In operation, release button (82) of release (80) is positioned in opening (98) and contacts ratchet wheel (86). First teeth (84) are positioned proximate opening (98) and are adapted to engage ratchet wheel (86) supported by axle (96). Spring (102) rides against ratchet wheel (86) of rotatable body (66), and spring (102) bias ratchet wheel (86) toward first teeth (84). Cavity (104) is provided with second teeth (100) adapted to engage ratchet wheel (86). As shown in the preferred embodiment of FIG. 6, substance (78), capable of attracting a magnet, is provided. Fastener (108) secures rotatable body (66), spring (102), axle (96), ratchet wheel (86) and mount (94). In operation, when a user engages release button (82), ratchet wheel (86) disengages from first teeth (84) allowing rotatable body (66) to rotate in a direction that releases pivoting clasp (60) from engaging member (24) of ladder (20).

Figure 7:
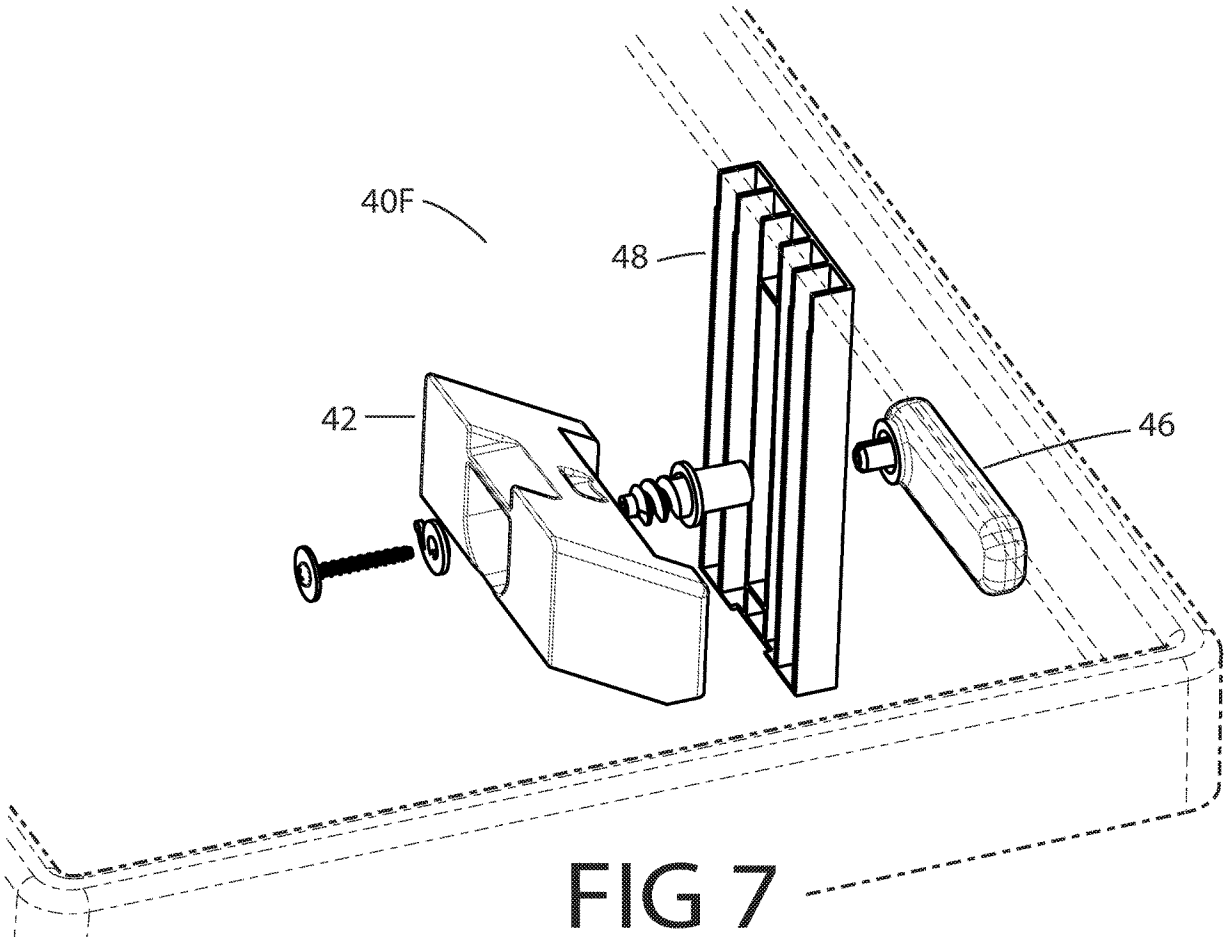
FIG. 7 is an exploded perspective of a preferred embodiment of first component (40F) of the connector.
Figure 8:
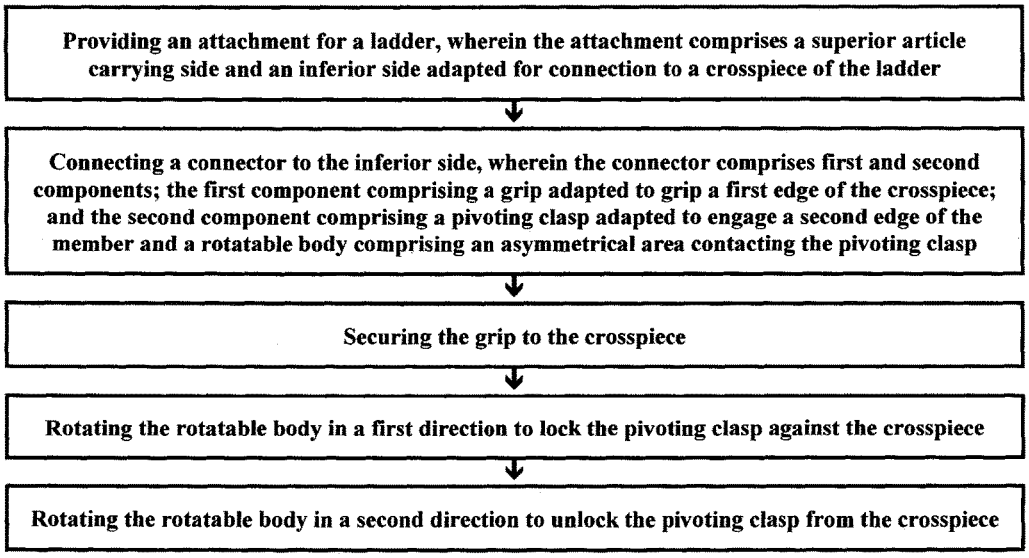
FIG. 8 is a depiction of steps associated with using a preferred embodiment of attachment (30).
Figure 9:
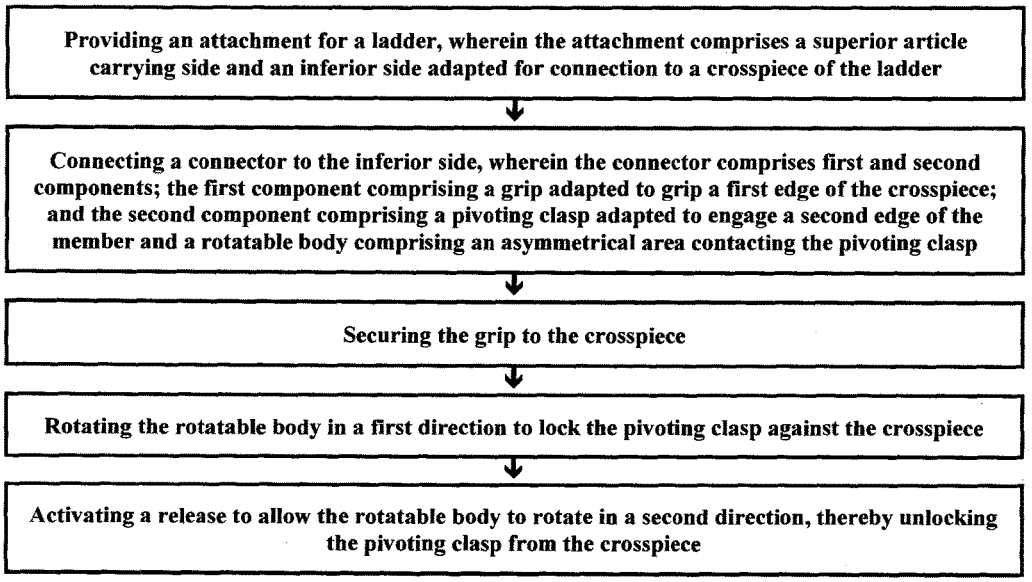
FIG. 9 is a depiction of steps associated with using another preferred embodiment of attachment (30).
Figure 10:
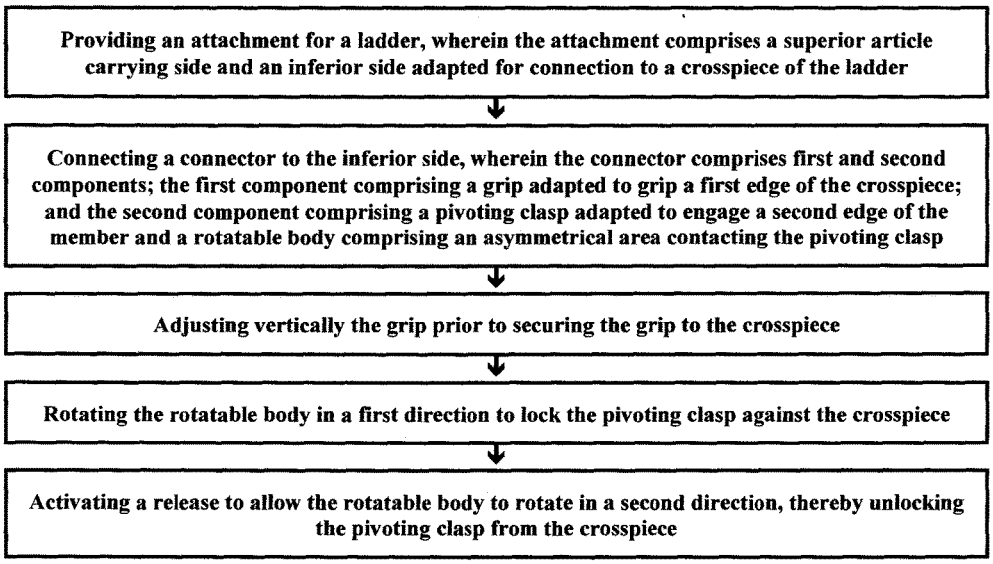
FIG. 10 is a depiction of steps associated with using still another preferred embodiment of attachment (30).
Figure 11:
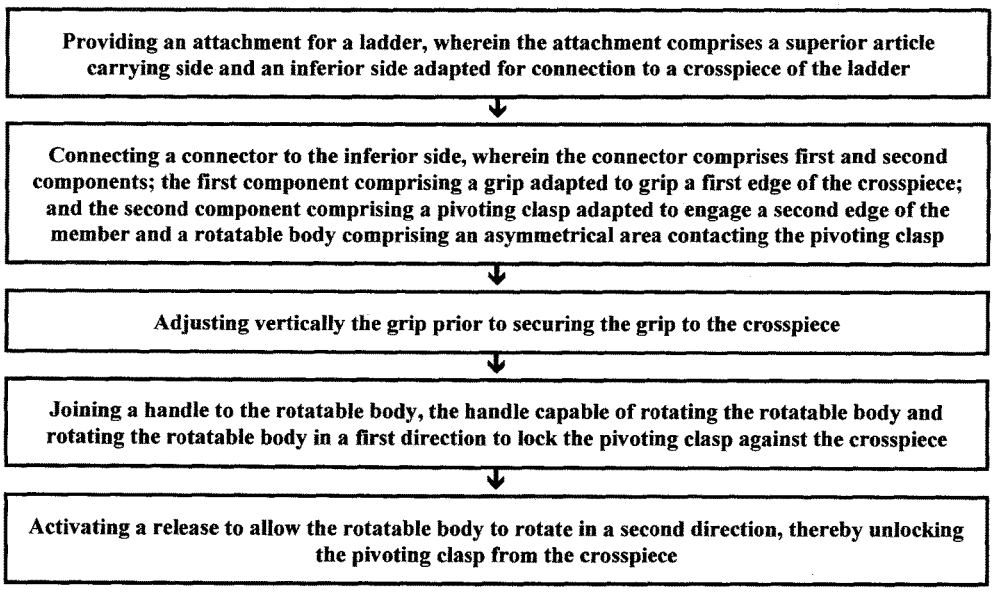
FIG. 11 is a depiction of steps associated with using yet another preferred embodiment of attachment (30).
Figure 12:
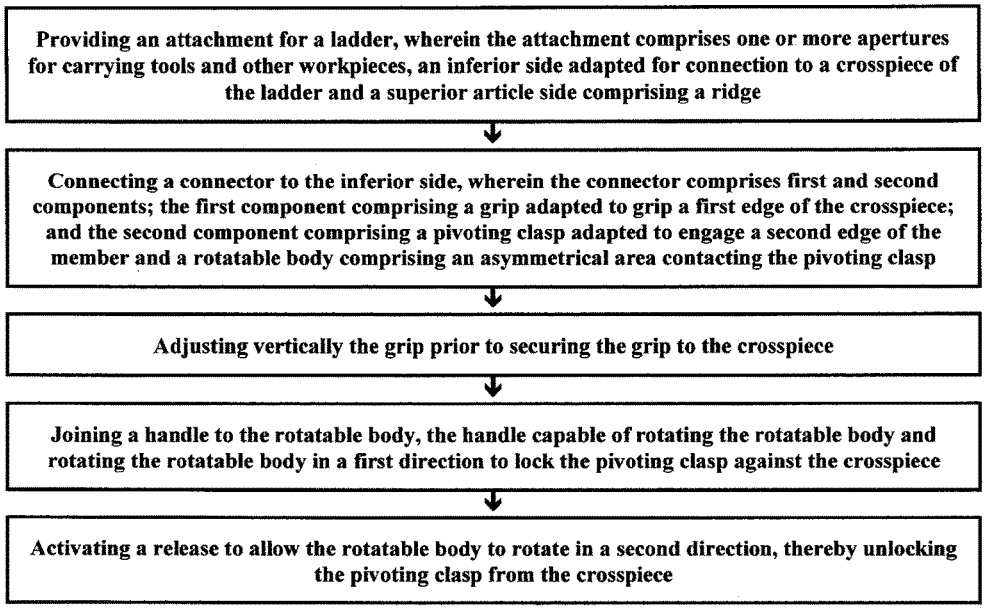
FIG. 12 is a depiction of steps associated with using yet still another preferred embodiment of attachment (30).

FIG. 7 is an exploded perspective of a preferred embodiment of first component (40F) of connector shown in FIGS. 1-5.

Steps associated with the practice of methods associated with preferred embodiments of the current invention are illustrated in FIGS. 8-12.

Select preferred embodiments of the current invention have been disclosed and enabled as required by Title 35 of the United States Code.

What is claimed is:

1. An attachment for a ladder; said ladder including a top piece spanning between opposed legs of said ladder; said attachment comprising:

a) a superior side for carrying articles; and b) an inferior side opposite said superior side adapted to contact at least a portion of said top piece; said inferior side comprising:

i) an extension extending away from said inferior side; said extension further comprising:

a slot;

a slidable grip riding along said slot; and a lock adapted to lock said slidable grip against a first edge of said top piece;

ii) first and second mounts opposite said extension; said mounts extending away from said inferior side;

iii) a shaft extending between said second mounts;

iv) an axle extending from said first mount;

v) a pivoting clasp carried by said shaft; said clasp adapted to engage a second edge, opposite said first edge, of said top piece;

vi) a handle extending from a rotatable body; said rotatable body carried by said axle and adapted to engage said pivoting clasp such that a first rotation of said rotatable body forces said pivoting clasp to lock against said second edge; and vii) a release adapted to allow said rotatable body to rotate in a second direction, thereby unlocking said pivoting clasp from said second edge.

2. The attachment of claim 1, wherein said release comprises a ratcheting mechanism.

3. The attachment of claim 2, wherein said rotatable body comprises an asymmetrical area contacting said pivoting clasp.

4. The attachment of claim 3 comprising one or more apertures extending between said superior side and said inferior side, a ridge extending upward from said superior side or both.

5. An attachment for a ladder including a member spanning between opposed legs of said ladder; said attachment comprising:

a) a superior side for carrying articles; and b) an inferior side adapted to contact at least a portion of said member; said inferior side comprising:

i) an extension extending away from said inferior side; said extension further comprising: a lock adapted to lock a slidable grip against a first edge of said member;

ii) first and second mounts opposite said extension; said mounts extending away from said inferior side;

iii) a shaft extending between said second mounts;

iv) an axle extending from said first mount;

v) a pivoting clasp carried by said shaft; said clasp adapted to engage a second edge of said member;

vi) a rotatable body carried by said axle; said rotatable body adapted to engage said pivoting clasp such that a first rotation of said rotatable body forces said pivoting clasp to lock against said second edge.

6. The attachment of claim 5 comprising a release adapted to allow said rotatable body to rotate in a second direction, thereby unlocking said pivoting clasp from said second edge.

7. The attachment of claim 6, wherein said rotatable body comprises an asymmetrical area contacting said pivoting clasp.

8. The attachment of claim 7, wherein said rotatable body comprises a handle.

9. The attachment of claim 8, wherein said release comprises a ratcheting mechanism.

10. The attachment of claim 9, wherein said lock comprises a slot for said slidable grip.

11. The attachment of claim 10 comprising one or more apertures extending between said superior side and said inferior side, a ridge extending upward from said superior side or both.

12. An attachment for a ladder including a member spanning between opposed legs of said ladder; said attachment comprising:

a) a superior side for carrying articles;

b) an inferior side adapted to contact at least a portion of said member; and c) a connector connected to and depending downwardly from said inferior side and adapted to secure said attachment to said ladder; said connector comprising:

i) a grip gripping a first edge of said member;

ii) a pivoting clasp adapted to engage a second edge of said member; and iii) a rotatable body comprising an asymmetrical area contacting said pivoting clasp such that a first rotation of said rotatable body forces said pivoting clasp to clasp against said second edge.

13. The attachment of claim 12 comprising a release adapted to allow said rotatable body to rotate in a second direction, thereby unclasping said pivoting clasp from said second edge.

14. The attachment of claim 13, wherein said rotatable body comprises a handle.

15. The attachment of claim 14, wherein said grip is vertically adjustable.

16. The attachment of claim 15, wherein said release comprises a ratcheting mechanism.

17. The attachment of claim 16, wherein said connector comprises a slot allowing vertical adjustment of said grip.

18. The attachment of claim 17 comprising one or more apertures extending between said superior side and said inferior side, a ridge extending upward from said superior side or both.

* * * * *